US006790167B1

(12) United States Patent
Carlin et al.

(10) Patent No.: US 6,790,167 B1
(45) Date of Patent: Sep. 14, 2004

(54) ADJUSTABLE STRIKING BAG TRAINING APPARATUS

(75) Inventors: Mitch Carlin, Boca Raton, FL (US); Richard Tarozzi, Gales Ferry, CT (US)

(73) Assignee: Technical Knockout, Inc., Pompano Beach, FL (US)

( * ) Notice: Subject to any disclaimer, the term of this patent is extended or adjusted under 35 U.S.C. 154(b) by 79 days.

(21) Appl. No.: 10/054,782

(22) Filed: Jan. 23, 2002

(51) Int. Cl.[7] ..... A63B 69/20
(52) U.S. Cl. ..... 483/90; 482/83; 482/87
(58) Field of Search ..... 482/83–90; 473/441–445

(56) References Cited

U.S. PATENT DOCUMENTS

| | | | | |
|---|---|---|---|---|
| 547,730 | A | | 10/1895 | MacLearn |
| 581,462 | A | | 4/1897 | Hess |
| 2,085,161 | A | | 6/1937 | Kraus |
| 3,521,882 | A | | 7/1970 | Kiernan |
| 4,486,016 | A | | 12/1984 | Rubin |
| 4,903,966 | A | | 2/1990 | Liao |
| 5,330,403 | A | | 7/1994 | Kuo |
| 5,554,088 | A | * | 9/1996 | Zlojutro |
| 5,624,358 | A | | 4/1997 | Hestilow |
| 5,792,032 | A | * | 8/1998 | Williams et al. |
| 6,390,958 | B1 | * | 5/2002 | Chu |
| 6,464,621 | B1 | * | 10/2002 | Chen |

* cited by examiner

*Primary Examiner*—Jerome W. Donnelly
(74) *Attorney, Agent, or Firm*—Malin, Haley & DiMaggio, P.A.

(57) ABSTRACT

A striking bag apparatus which is easy to manufacture, assemble, transport or move, and adjust in height, and which is effectively self-supported such that no sparring partner is needed. The striking bag apparatus is composed of a hollow base, hollow cylindrical column, and striking pad. The striking pad is preferably a foam sleeve covered by a smooth striking surface installed around the upper portion of the cylindrical column which is held in a substantially vertical position by the base. Both the column and base may be filled with water, sand, metal shot, or other suitable weighting substance to provide for increased stability and support, via easily accessible fill apertures in the column and base. The height of the striking surface may be easily adjusted, without disassembly, by rotating the column within the base, in a simple "corkscrew" fashion. The base is provided with wheels to aid in moving the apparatus.

9 Claims, 4 Drawing Sheets

ADJUSTABLE STRIKING BAG TRAINING APPARATUS

BACKGROUND OF THE INVENTION

1. Field of the Invention

The present invention generally relates to the field of athletic training equipment and more specifically to self-supported striking bags and pads for use in exercises requiring punching, kicking or other striking movements involving the use of arms, hands, feet or legs.

2. Description of Related Art

In contact or combative sports training, striking devices such as punching bags, heavy bags and punching pads are well known in the art. These bags are normally suspended overhead using chains secured to the ceiling or supported by a stand on the ground. Conventional striking bags suspended from the ceiling are difficult and laborious to adjust in height as well as being difficult to transport. Conventional striking bags supported by the ground are bulky to transport because of the added size of the base and are difficult to adjust in height. Additionally, conventional striking bags supported by the ground are often poorly supported and unstable requiring a sparring partner to hold the bag in order to provide additional stability. Conventional heavy bags supported by the ground commonly include a large, bulky base making the apparatus difficult to move about. It is therefore to the effective resolution of the aforementioned problems and shortcomings that the present invention is directed.

BRIEF SUMMARY OF THE INVENTION

A striking bag apparatus which is sturdy, easy to assemble, transport, manufacture and adjust in height, and effectively self-supported so that no sparring partner is needed. The striking bag apparatus is composed of a hollow substantially cylindrical base, hollow cylindrical column, and padded striking surface.

The smooth padded striking surface is essentially a foam sleeve with a smooth vinyl covering, ideal for punching or kicking, and which is securely affixed around the upper portion of the column. The padded striking surface completely encircles the upper portion of the column, thus providing a large, uniform striking surface area. The column is secured and maintained in a substantially vertical position, received and supported by the base.

In the preferred embodiment, the base is constructed from two hollow base members though such should not be considered limiting. Each base member comprises half of the base. The opposing members incorporate corresponding alignment protrusions and recesses. When the hollow members are secured together a substantially cylindrical base is formed with an interior receiving cavity for receiving the lower end of the column and securing it therein. Alternatively, the base may be formed in any other suitable shape, or from more than two members. In the preferred embodiment, the outer surface of one base member is adapted with wheels located near the bottom of the base. By tilting the base, the wheels allow the assembled apparatus to be moved easily to any desired floor location.

The cylindrical receiving cavity and column are adapted with corresponding thread grooves and thread projections, respectively, which allow the height of the column to be adjusted by rotating the column within the base thereby adjusting the height of the column and striking surface thereon. This unique "cork screw" adjustment design feature allows for easy adjustment of the height of the column and striking surface with minimal effort.

The column includes longitudinally disposed fluted channels which add rigidity to the column and allow the column to be secured when in use. The top of the base is adapted with a flexible collar located at the top, or opening entrance of the receiving cavity. The receiving cavity receives the lower portion of the column and the collar secures it therein via one or more interlocking flanges which engage one or more of the fluted channels provided by the column thereby prevent the column from rotation when in use.

When fully assembled, the stability of the base can be increased by filling it with water, sand, metal shot, or any other suitable weighting substance, using one or more fill apertures provided by one or each base member. These fill apertures are easily accessible without disassembly of the apparatus. Additionally, the stability can be further increased by filling the column with water, sand, metal shot or any other suitable weighting substance using one or more fill aperture provided on the outer surface of the column. These fill apertures are preferably accessible without disassembly of the apparatus or removal of the striking surface.

In accordance with these and other objects which will become apparent hereinafter, the instant invention will now be described with particular reference to the accompanying drawings.

DETAILED DESCRIPTION OF THE INVENTION

Figure 3:
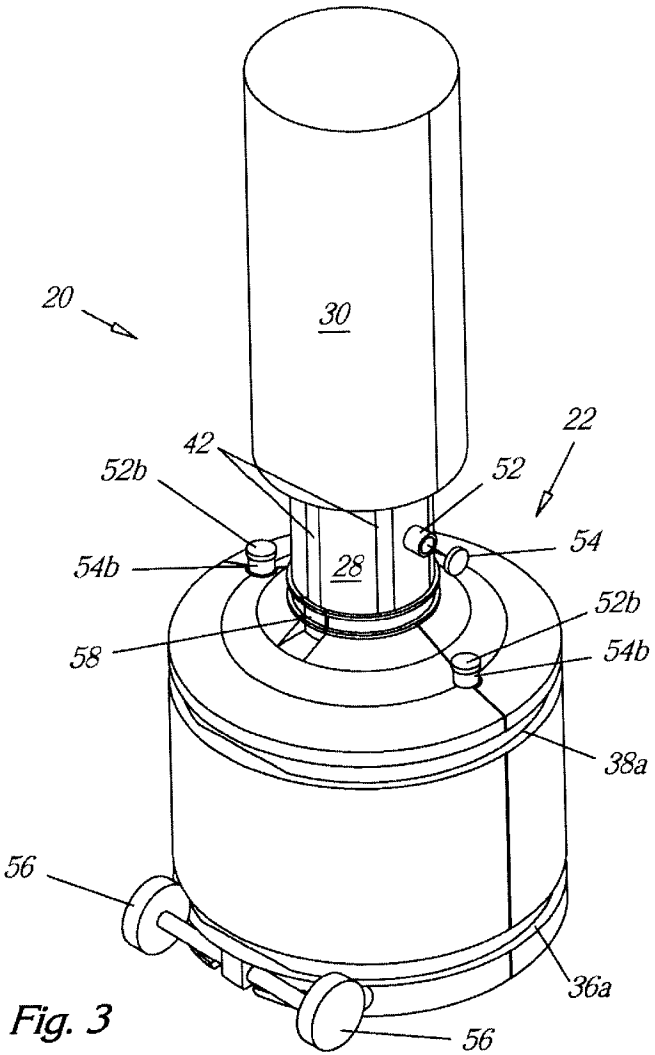
FIG. 3 is a perspective view of the preferred embodiment of the invention illustrating the attachment of wheels to the outer surface of the base.

Referring now to the drawings and more particularly to FIG. 3, there is shown the assembled striking bag apparatus generally designated 20 which comprises the preferred embodiment of the invention. Striking bag apparatus 20 basically includes a hollow, substantially cylindrical base 22, a hollow cylindrical column 28, and a padded striking surface 30.

Figure 1:
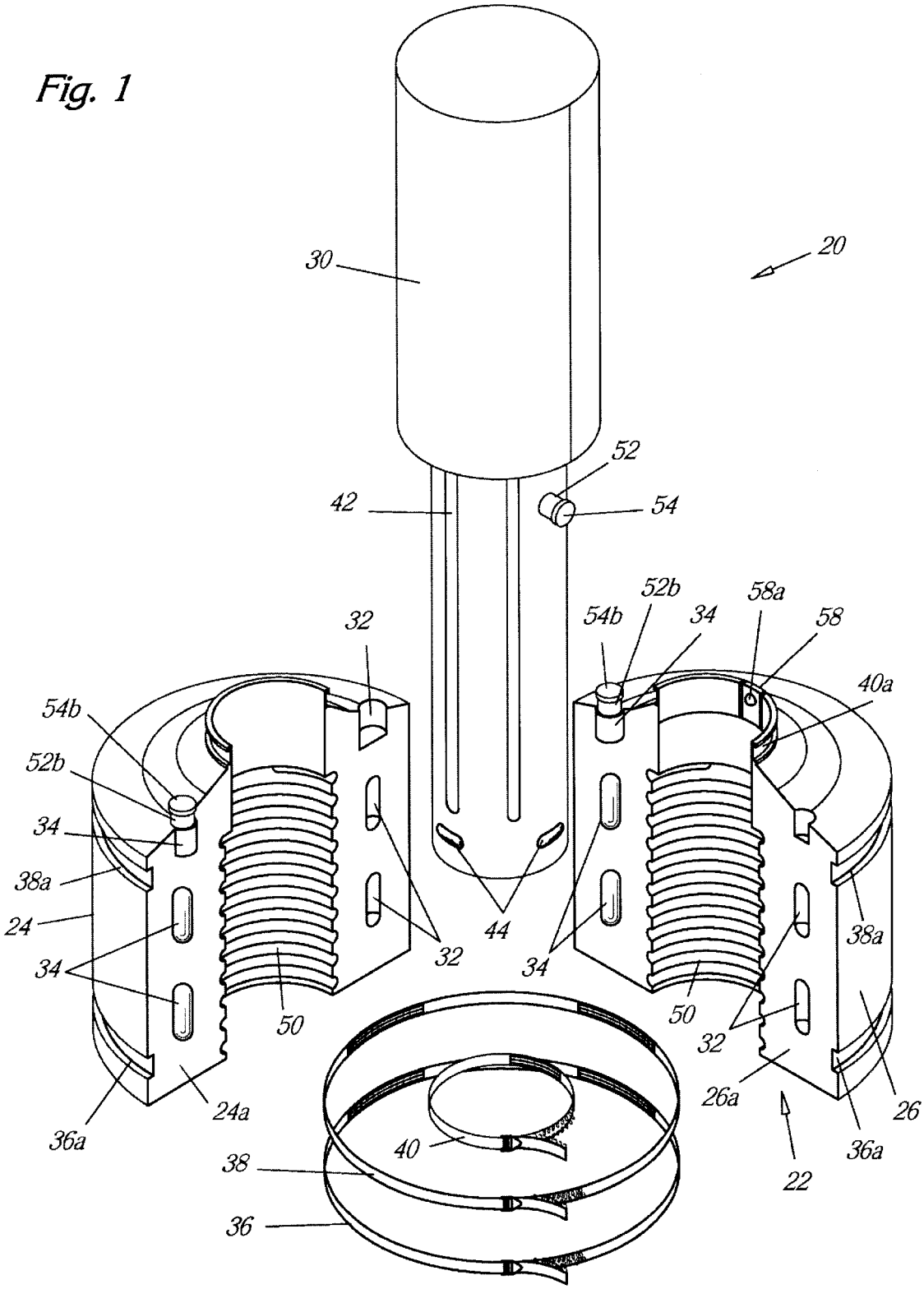
FIG. 1 is an exploded perspective view of the preferred embodiment of the invention.

Referring now to FIG. 1, an exploded view of the present invention can be seen. Padded striking surface 30 is affixed around the upper portion of column 28. Padded striking surface 30 acts as a sleeve securely affixed around column 28, and is preferably comprised of foam cushioning covered by a durable striking surface such as vinyl. Alternatively, padded striking surface 30 may be constructed of one integral cushion formed to encircle column 28. Other coverings providing a uniform smooth cushioned striking surface may also be utilized.

Column 28 which may be constructed from injection molded plastic or other suitable material includes one or more fluted channels 42 which extend the substantial length of column 28 around its outer periphery, to add rigidity to the apparatus. Another function of the channels 42 is to allow column 28 to be raised and lowered after it has been secured within the receiving cavity of base 22. A plurality of threaded projections 44 extend from the bottom end of column 28. In an alternate embodiment, a continuous threaded projection extends outwardly from around the bottom end of column 28. When column 28 is installed and rotated within base 22, projections 44 become engaged with threaded grooves 50, positioned within the interior of base 22. These grooves spiral along the interior of base 22 thereby allowing the position of column 28 to change, by either raising or lowering column 28 within base 22. Padded striking surface 30 and column 28 are maintained in a substantially vertical position by base 22.

One or more fill apertures 52 are provided along the outer circumference of column 28, preferably located below the installed striking surface, thereby allowing column 28 to be filled with water, sand, metal shot or any other suitable weighting material without removal of the installed striking surface 30. Each fill aperture is provided with a fill cap 54.

Base 22 is preferably formed by two opposing hollow base members 24 and 26. Base members 24 and 26 are constructed of injection molded plastic though such should not be considered limiting. In an alternate embodiment, base 22 is constructed of three or more hollow base members. One or more alignment protrusions 34 and corresponding recesses 32 are provided along the inner surface 24*a* of base member 24 and the inner surface 26*a* of base member 26 respectively. Each protrusion 34 on one base member is received by a corresponding recess 32 on the opposing base member. This helps the user align the two members 24 and 26 during assembly. When inner surface 24*a* and 26*a* are properly aligned so that all protrusions 34 are properly received by corresponding recesses 32, cylindrical base 22 is formed.

Members 24 and 26 include one or more fill apertures 52*b* located, preferably on the top of members 24 and 26, allowing base 22 to be filled with water, sand, metal shot or any other suitable weighting material. Each fill aperture 52*b* is provided with fill cap 54*b*. Hollow base members 24 and 26 are virtually identical thereby allowing many to be manufactured at once. Further, when assembled, base 22 is lightweight and easily transportable.

Members 24 and 26 are held together by banded straps 36, 38 and 40, which are adapted in size to fit around the circumference of base member 22 at particular areas. Straps 36, 38 and 40, include a buckle and hook and loop fasteners to allow tightening and loosening of the straps to conform to the contours of base 22 and are constructed of nylon, leather or any other suitable strap material. The outer surface of members 24 and 26 are adapted with strap channels 36*a*, 38*a* and 40*a* which receive straps 36, 38 and 40, respectively, around the circumference of base 22 to aid in alignment and further secure the straps therein.

Figure 6:
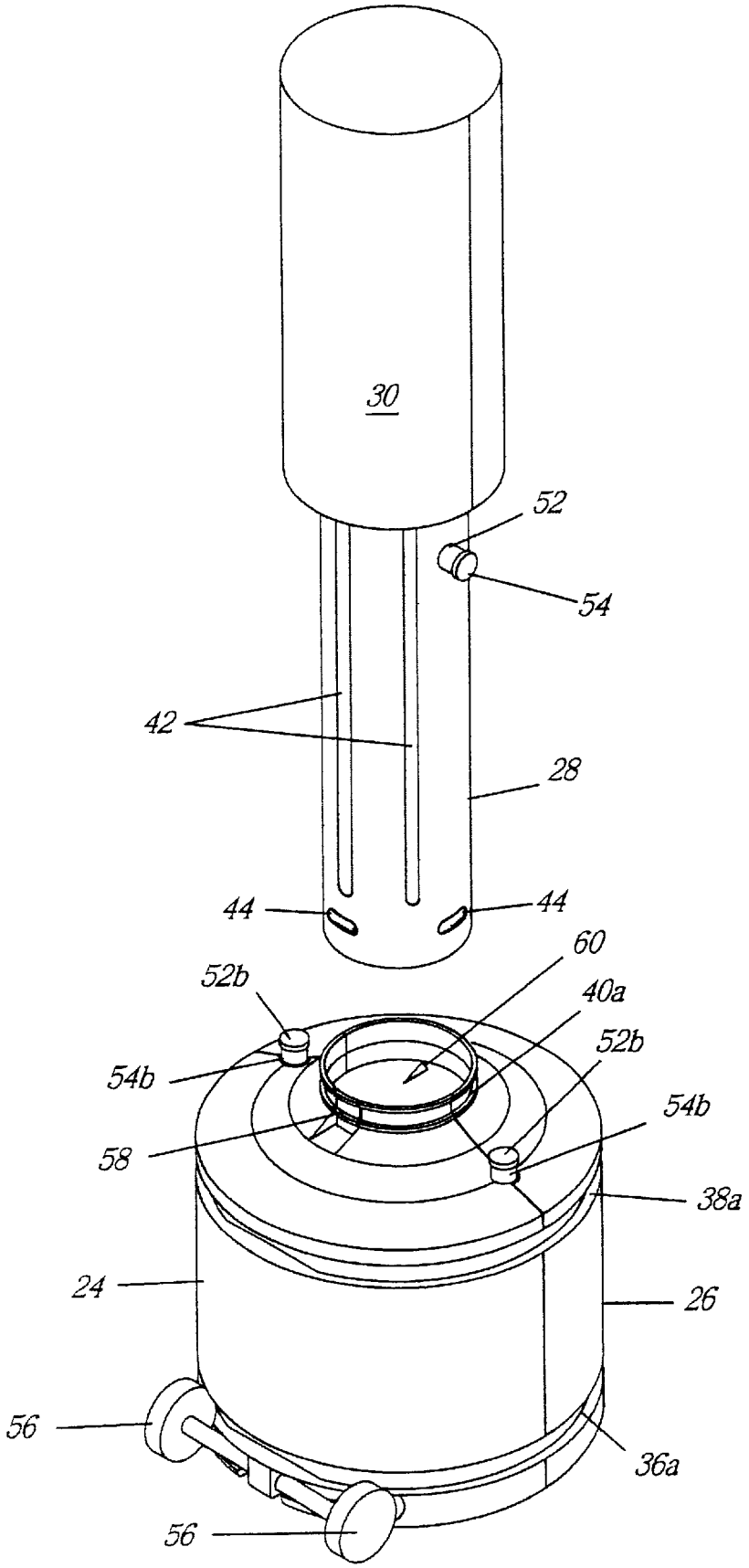
FIG. 6 is a perspective view of the preferred embodiment of the invention with the column withdrawn from within the base.

Referring to FIG. 6, base 22 defines a substantially cylindrical receiving cavity 60 through its interior for adjustably receiving column 28. Cylindrical receiving cavity 60 contains threaded grooves 50 as seen in FIG. 1 around its inner circumference, which receive thread projections 44 of column 28. Grooves 50 are spirally situated along the interior surface of base 22 and thereby adapted to allow the height of column 28, when installed within base 22, to be adjusted by rotating column 28 within cylindrical receiving cavity 60. When column 28 is installed and rotated within base 22, projections 44 travel within grooves 50 causing the position of the column to change, either raising or lowering column 28 within base 22 depending on which direction column 28 is rotated.

In an alternate embodiment of the invention, cylindrical receiving cavity 60 contains several parallel, non-spiraling horizontal channels or grooves which receive thread projections 44 of column 28. This allows the user to specify and "lock in" the height of the column and striking pad thereon, at the time of assembly.

Figure 2:
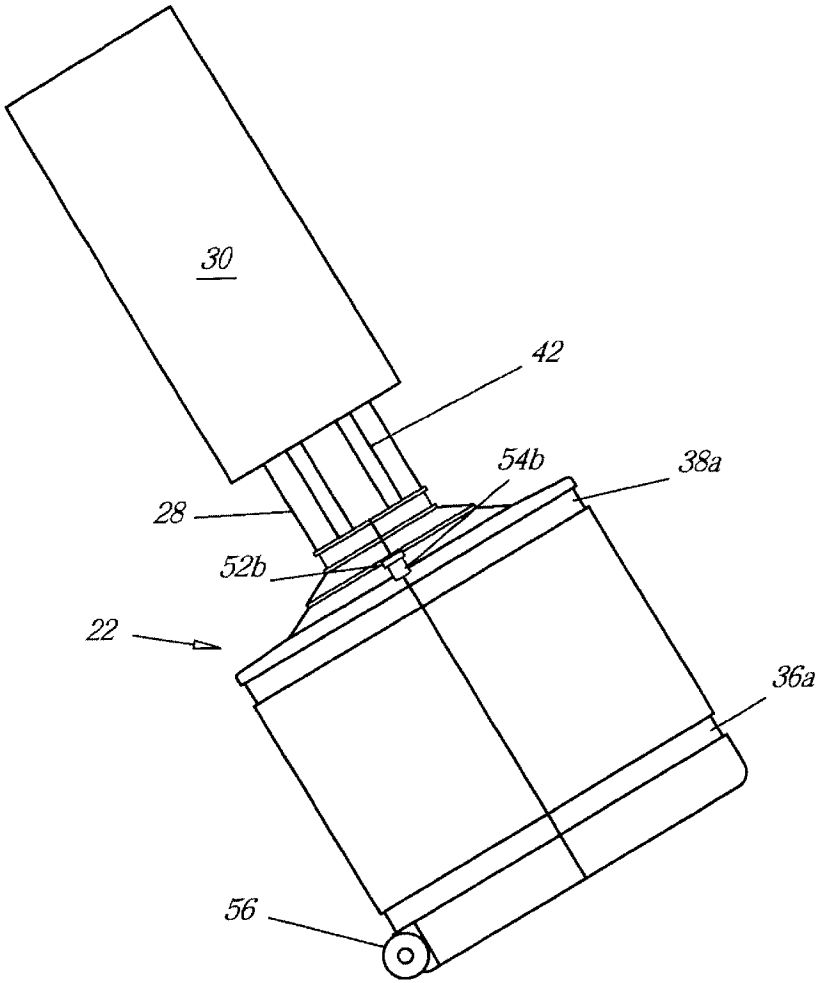
FIG. 2 is a side view of the preferred embodiment of the invention.

Referring now to FIGS. 2 and 3, the preferred embodiment of the assembled striking apparatus 20 is illustrated. Column 28 is received by and enclosed within base 22. Wheels 56 are provided at the outer surface of base 22 which allows the user to tilt apparatus 20, as shown in FIG. 2, and roll it to the desired floor location. The height of striking surface 30 can be adjusted by rotating column 28 within base 22. The 'corkscrew' mechanism defined by threaded projections 44 and corresponding grooves 50 allows the user to easily raise and lower the striking surface to virtually any desired position by merely rotating column 28.

After obtaining the desired height by rotating column 28, the user can lock in the height and prevent the column from unwanted rotation by utilizing the stopping mechanism described below.

A flexible collar section 58 adapted with one or more interlocking flanges 58*a* is provided within strap channel 40*a*, which interlocks with one ore more of the fluted channels 42 provided by column 28 when strap 40 is properly secured, preventing the unwanted rotation of column 28 within base 22, during use. Therefore, to choose and maintain a desired striking surface height, the user simply rotates column 28 until striking surface 30 is at the desired height and inserts the easily-accessible flange 58*a* within one of the exposed fluted channels 42, to lock the column in place.

Figure 5:
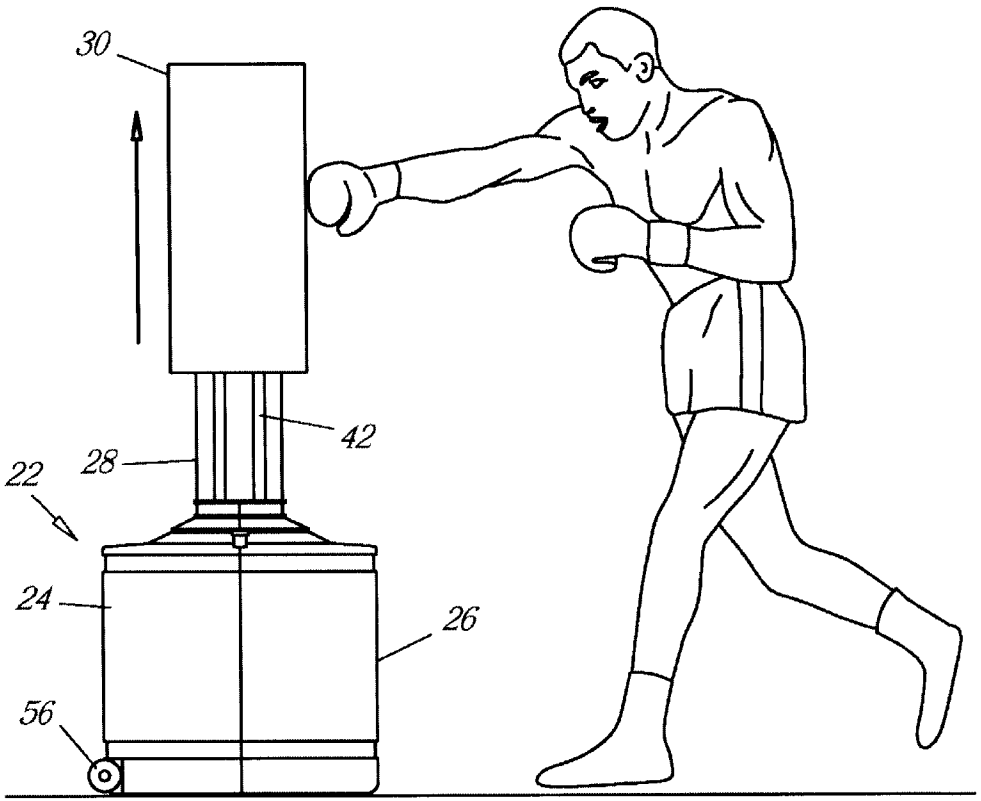
FIG. 5 is a side elevational view of the preferred embodiment of the invention illustrating the striking surface in a raised position.
Figure 4:
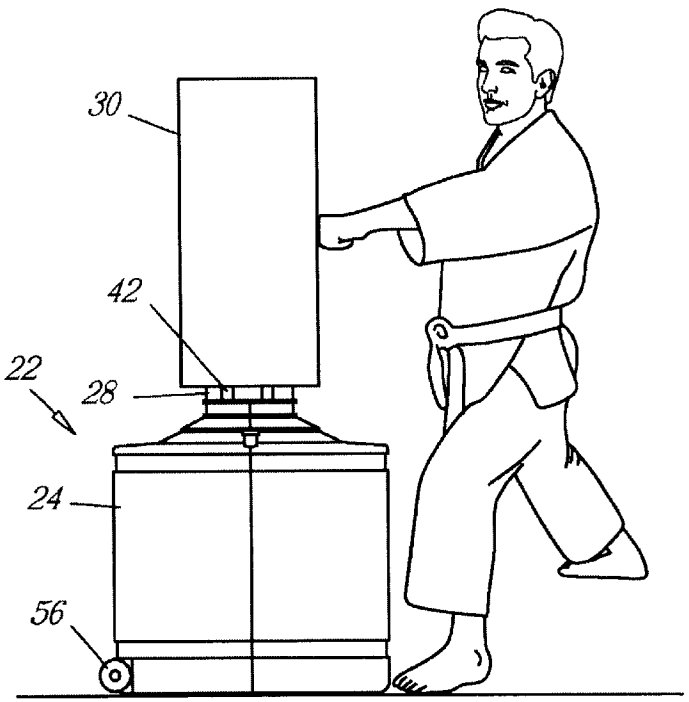
FIG. 4 is a side elevational view of the preferred embodiment of the invention illustrating the striking surface in a lowered position.

Referring now to FIGS. 4 and 5, it is clearly shown that a wide variety of striking surface heights can be obtained. An optimal striking target for users of virtually any height can be achieved using the mechanism described above.

The instant invention has been shown and described herein in what is considered to be the most practical and preferred embodiment. It is recognized, however, that departures may be made therefrom within the scope of the invention and that obvious modifications will occur to a person skilled in the art.

Among the improvements of this invention over the prior art, the interaction between the threaded grooves 50 and the protusions 44 allow for a greater range of vertical positioning for the column 28 hetherto unknown.

What is claimed is:

1. A striking bag training apparatus comprising a hollow base, a hollow substantially cylindrical column and a padded striking surface, said striking surface affixed to the upper portion of said column, said base having a substantially cylindrical receiving cavity adapted to receive the bottom end of said column so that said column is maintained in a substantially vertical position, said apparatus having a means for adjusting the height of said column and said striking surface hereon, within said base, wherein the means for adjusting the height of said column within said base are projections extending from the bottom of said column received by threaded grooves within said receiving cavity of said base, said threaded grooves adapted to allow the column to be raised or lowered by rotating said column within said base.

2. The apparatus of claim 1 wherein said column further comprises one or more column fill apertures and corresponding column fill caps and said base having one or more base fill apertures and corresponding base fill caps, said fill apertures allowing a weighted substance to be inserted within said column and said base.

3. The apparatus of claim 1 wherein said column further includes one or more longitudinally disposed fluted channels which extend the substantial length of the column, and wherein the top of said base further includes a flexible collar section having one or more interlocking flanges, said flanges to engage one or more said fluted channels thereby preventing unwanted rotation of said column when said apparatus is in use.

4. The apparatus of claim 3 wherein said base is comprised of two or more base members having top, bottom and inner and outer surfaces, each base member having one or more said base member fill apertures and corresponding said base fill caps, said inner surfaces having corresponding alignment protrusions and corresponding alignment recesses, said base members attached to each other by an attachment means so that said inner surfaces contact each other and said alignment protrusions and recesses are engaged forming said base.

5. The apparatus of claim 4 where said attachment means are one or more tightening straps which encircle the outer circumference of said base, said base having one or more corresponding strap channels which receive said tightening straps, said one or more interlocking flanges of said flexible collar section is further secured within one or more of said channels by securing one of said tightening straps around said flexible collar section.

6. The apparatus of claim 1 wherein said base further includes wheels adapted to allow said apparatus to be transferred to another location.

7. The apparatus of claim 3 wherein said one or more interlocking flanges of said flexible collar section is further secured to one or more said fluted channels by securing one said tightening strap around said flexible collar section.

8. A striking bag training apparatus comprising:

a hollow, substantially cylindrical column including one or more column fill apertures and corresponding column fill caps to allow a weighted substance to be inserted within said column, said column further including one or more longitudinally disposed fluted channels which extend the substantial length of the column;

a hollow base comprised of two or more base members having a substantially cylindrical receiving cavity adapted to receive the bottom end of said column so that said column is maintained in a substantially vertical position, said base members further including alignment protrusions and corresponding alignment recesses along its inner surface;

said base having one or more base fill apertures and corresponding base fill caps, to allow a weighted substance to be Inserted within said base and wherein the top of said base further includes a flexible collar section having one or more interlocking flanges, said flanges adapted to engage one or more said fluted channels in said column thereby preventing unwanted rotation of said column when said apparatus is in use;

a padded striking surface affixed to the upper portion of said column;

means for adjusting the height of said column and said striking surface thereon, within said base, said means comprising projections extending from the bottom of said column adapted for engaging threaded grooves within said receiving cavity of said base, said threaded grooves adapted to allow the column to be raised or lowered by rotating said column within said base;

one or more tightening straps to aid in further alignment of said base members, said straps adapted to encircle the outer circumference of said base, said base having one or more corresponding strap channels which receive said tightening straps, said one or more interlocking flanges of said flexible collar section is further secured within one or more of said channels by securing one of said tightening straps around said flexible collar section; and a plurality of wheels adapted to allow said apparatus to be transferred to another location.

9. A striking bag training apparatus comprising a hollow base, a hollow substantially cylindrical column and a padded striking surface, said striking surface affixed to the upper portion of said column, said base having a substantially cylindrical receiving cavity adapted to receive the bottom end of said column so that said column is maintained in a substantially vertical position, said apparatus having a means for adjusting the height of said column and said striking surface hereon, within said base, wherein said column further comprises one or more column fill apertures and corresponding column fill caps and said base having one or more base fill apertures and corresponding base fill caps, said fill apertures allowing a weighted substance to be inserted within said column and said base.

* * * * *